US009427608B2

(12) United States Patent
Fink et al.

(10) Patent No.: US 9,427,608 B2
(45) Date of Patent: Aug. 30, 2016

(54) SELF-RETRACTING LIFELINE CONNECTING SYSTEM

(71) Applicant: Honeywell international Inc., Morristown, NJ (US)

(72) Inventors: Jeremy Fink, Morristown, NJ (US); Bradley Rohlf, Morristown, NJ (US); Shelly Mihalic, Morristown, NJ (US)

(73) Assignee: Honeywell International Inc., Morris Plains, NJ (US)

( * ) Notice: Subject to any disclaimer, the term of this patent is extended or adjusted under 35 U.S.C. 154(b) by 495 days.

(21) Appl. No.: 13/892,127

(22) Filed: May 10, 2013

(65) Prior Publication Data

US 2014/0331459 A1 Nov. 13, 2014

(51) Int. Cl.
*A63B 35/00* (2006.01)
*A62B 35/00* (2006.01)

(52) U.S. Cl.
CPC ..... *A62B 35/0037* (2013.01); *A62B 35/0075* (2013.01); *Y10T 24/318* (2015.01)

(58) Field of Classification Search
CPC ..... Y10T 24/4764; Y10T 24/318; A62B 35/0031; A62B 35/0025; A62B 35/0037; A62B 35/0075; A62B 35/04
See application file for complete search history.

(56) References Cited

U.S. PATENT DOCUMENTS 1,877,702 A * 9/1932 St. Clair ..... 24/598.4
4,005,904 A * 2/1977 Weman et al. ..... 297/483
5,131,490 A 7/1992 Bell
6,253,874 B1 7/2001 Casebolt et al.
6,637,377 B2 * 10/2003 Lobanoff et al. ..... 119/792
7,086,091 B2 8/2006 Jordan
7,178,632 B2 2/2007 Casebolt et al.
7,946,387 B2 * 5/2011 Betcher et al. ..... 182/231
8,177,025 B2 5/2012 Lang et al.
2005/0067221 A1 * 3/2005 Wolner et al. ..... 182/3
2005/0067222 A1 * 3/2005 Casebolt et al. ..... 182/30
2005/0082114 A1 * 4/2005 Casebolt et al. ..... 182/3
2005/0205356 A1 * 9/2005 Velasco, Jr. ..... 182/3
2006/0102423 A1 * 5/2006 Lang et al. ..... 182/36
2007/0181863 A1 * 8/2007 Plzak ..... 254/338
2007/0209868 A1 * 9/2007 Betcher et al. ..... 182/3
2008/0060873 A1 * 3/2008 Lang et al. ..... 182/3
2009/0211849 A1 * 8/2009 Smith et al. ..... 182/231

(Continued)

OTHER PUBLICATIONS

Nano-Lok, Brochure, Self Retracting Lifelines, 6 pages, Capital Safety, capitalsafety.com, copyrighted 2011.

*Primary Examiner* — Daniel Cahn
(74) *Attorney, Agent, or Firm* — Craige Thompson; Thompson Patent Law

(57) ABSTRACT

Apparatus and associated methods may relate to a Self-Retracting Lifeline Connecting System (SRLCS) that securely attaches to a fall-protection safety harness, and further provides connections to a plurality of safety devices. In an illustrative example, the SRLCS may include a D-pad adapted for rear attachment to a back-pad of a safety harness. In some examples the D-pad may have webbing apertures through which two sections of webbing may be threaded in a criss-crossed manner. In some embodiments, the D-pad may provide an attachment for a first harness ring. In some exemplary embodiments, the D-pad may also provide a tunnel structure for routing a second harness ring therethrough. In an illustrative example, the tunnel may be located immediately adjacent the criss-cross location of the two sections of webbing, thereby permitting a carabiner to make use of the tunnel to capture the two sections of webbing.

16 Claims, 15 Drawing Sheets

(56) References Cited

U.S. PATENT DOCUMENTS

2011/0290586 A1* 12/2011 Goldmann et al. ..... 182/3
2013/0008742 A1* 1/2013 Schurian et al. ..... 182/3
2013/0104351 A1* 5/2013 Casebolt ..... 24/522
2014/0227022 A1* 8/2014 Casebolt ..... 403/57
2014/0262608 A1* 9/2014 Patel et al. ..... 182/3
2015/0076193 A1* 3/2015 Bratcher ..... 224/250

* cited by examiner

SELF-RETRACTING LIFELINE CONNECTING SYSTEM

TECHNICAL FIELD

Various embodiments relate generally to fall-protection systems.

BACKGROUND

Fall-protection safety harnesses are widely used in today's industrial world. Many occupations require workers to operate at great heights. These workers perform functions demanded by our modern world. Some examples of such occupations include bridge inspectors, high-rise construction operators, skyscraper window washers, etc. Individuals who work in such occupations require safety measures that are robust. But the safety equipment that is necessary must also permit the workers to accomplish the tasks at hand. It would be impractical, for example, if the safety measures were robust, but the safety equipment which accomplishes that measure of safety were so heavy as to render the worker immobile.

Companies who employ individuals to work at dangerous heights also have a concern for their well-trained employees. Such companies truly desire their employees to use the appropriate safety products, and to use them correctly. Thus, companies desire to use equipment that is easy to employ, and comfortable to wear. The easier such equipment is to use, the more likely the employee will use it properly. Furthermore, the more comfortable such equipment is to wear, the more likely an employee will wear it. Finally, if safety equipment is made to be easy to use, it becomes unlikely that the equipment will be accidentally misused.

SUMMARY

Apparatus and associated methods may relate to a Self-Retracting Lifeline Connecting System (SRLCS) that securely attaches to a fall-protection safety harness, and further provides connections to a plurality of safety devices. In an illustrative example, the SRLCS may include a D-pad adapted for rear attachment to a back-pad of a safety harness. In some examples the D-pad may have webbing apertures through which two sections of webbing may be threaded in a criss-crossed manner. In some embodiments, the D-pad may provide an attachment for a first harness ring. In some exemplary embodiments, the D-pad may also provide a tunnel structure for routing a second harness ring therethrough. In an illustrative example, the tunnel may be located immediately adjacent to the criss-cross location of the two sections of webbing, thereby permitting a carabiner to make use of the tunnel to capture the two sections of webbing.

Various embodiments may achieve one or more advantages. For example, in some embodiments, where the tunnel is rigidly fixed to the D-pad, the weight of any attached safety equipment may substantially reduce or eliminate pulling on the webbing that tends to make the webbing sag. For example, the weight of attached equipment may be substantially supported by the rigid tunnel structure. Various embodiments may permit both carabiner and D-ring attachments to the webbing, the D-ring being available for a rescue hook attachment in the event of a fall. In another exemplary embodiment the tunnel structure may ease the capture of the webbing by a carabiner, because the tunnel may present an introduction behind the webbing to the open end of a carabiner. Some embodiments may employ a webbing retainer clip to help center the carabiner on the D-pad. Various embodiments may use a large webbing aperture of the webbing retainer clip to permit the webbing to readily slide as needed during operation. In some embodiments, the webbing is retained with a rotatable webbing retainer clip that substantially opposes/avoids any tendency to open the gate during a fall. In such a fall event, the webbing retaining clip may release from the carabiner, but because its rotation may oppose that of the first action of the carabiner's gate, any tendency to open the gate may be substantially reduced or minimized. In some embodiments, the use of SRL bushings may prevent or substantially reduce abrasion of the carabiner by the SRL swivel connectors.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary SRLCS is briefly introduced with reference to FIGS. 1-3. Second, with reference to FIGS. 4-6, the discussion turns to exemplary embodiments that illustrate both the back-pad connection to a webbing harness and a tunnel to provide a carabiner a via to capture a webbing. Then, with reference to FIG. 7, an exemplary webbing retainer clip will be discussed. Finally, with reference to FIGS. 8-9, discussion will turn to exemplary SRL bushings which may be used to prevent abrasion of the connecting carabiner.

Figure 1A:
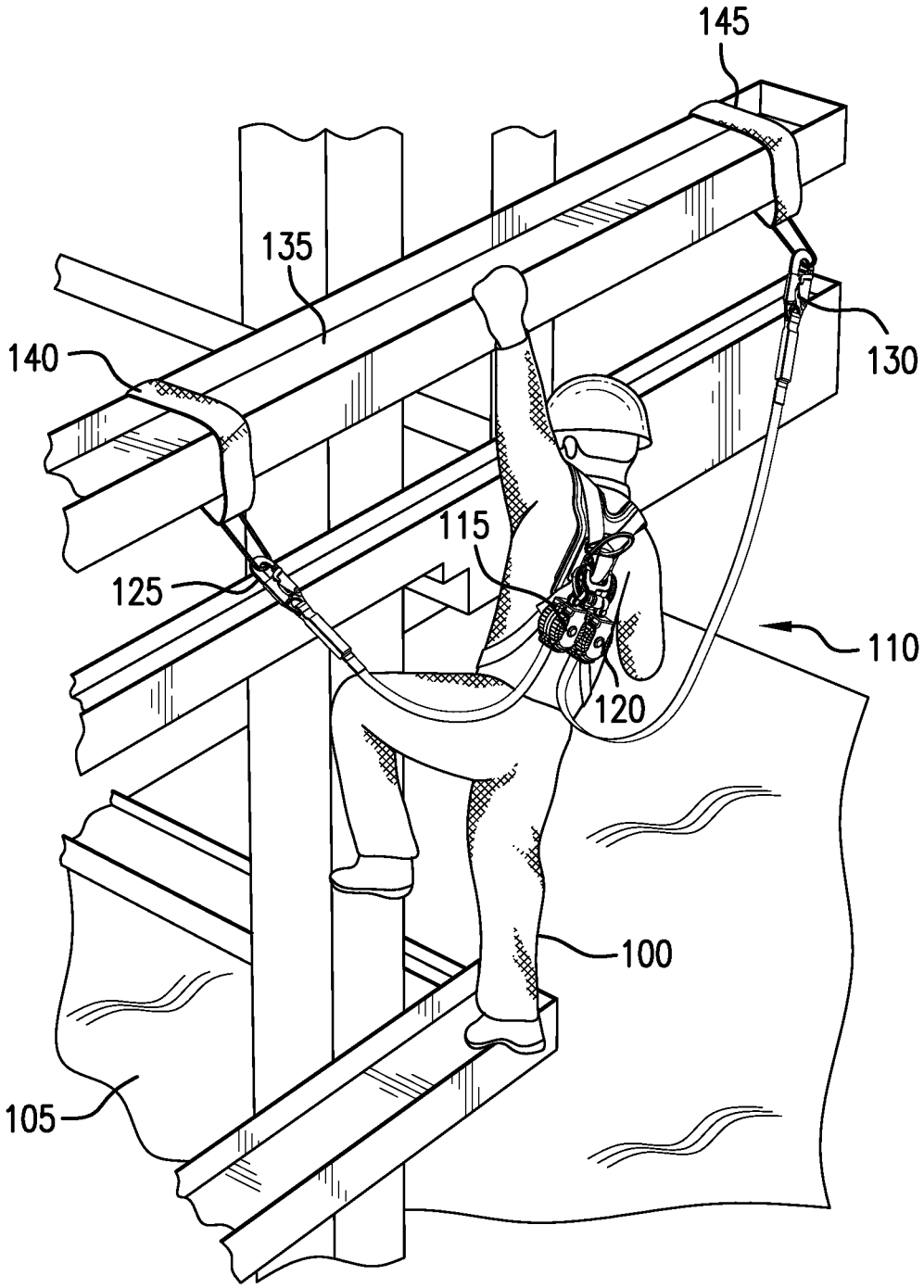
FIGS. 1*a*-1*c* depict a sketch of a field implementation of an exemplary Self-Retracting Lifeline Connecting System (SRLCS) used for fall protection.
Figure 1B:
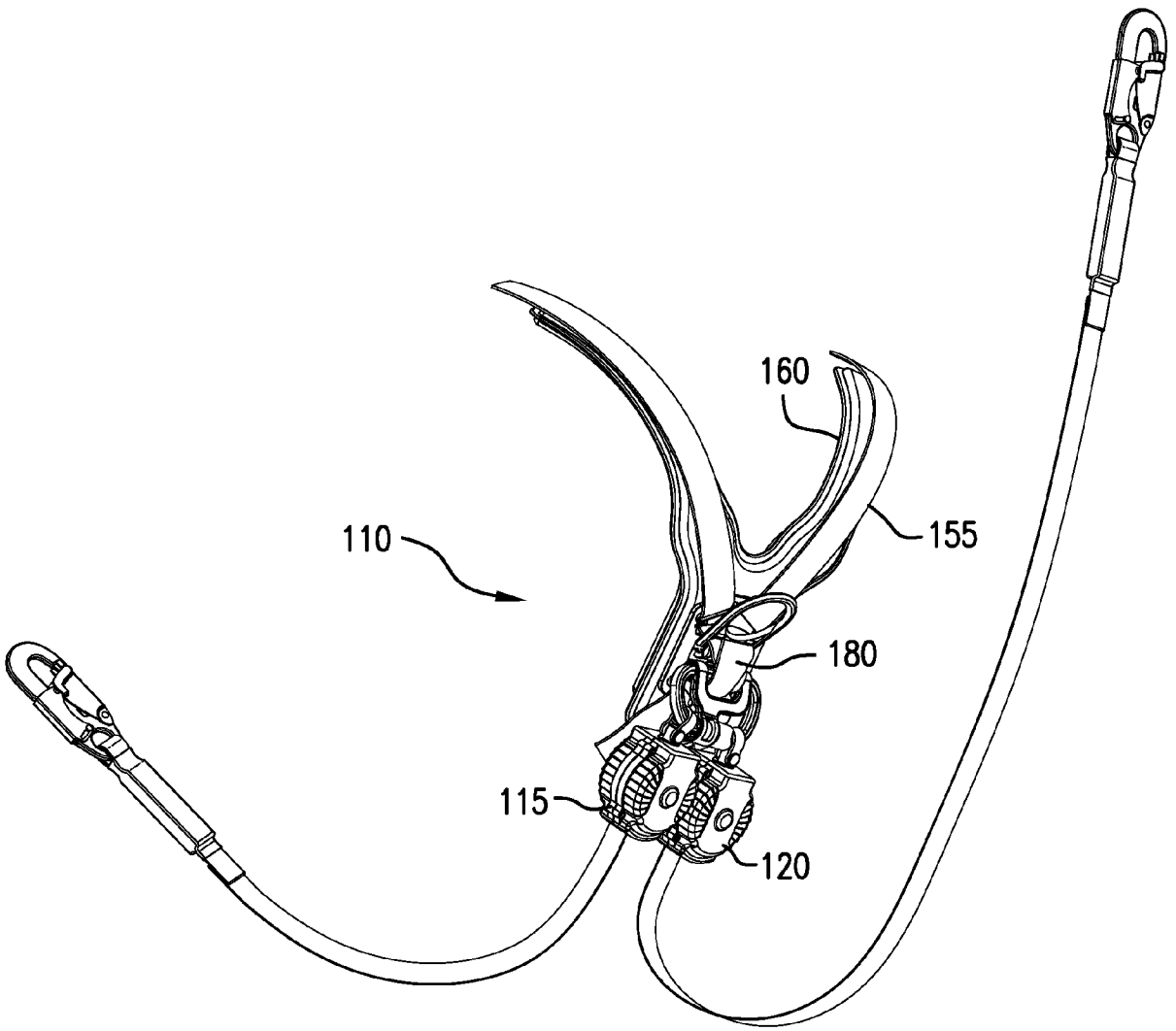
Figure 1C:
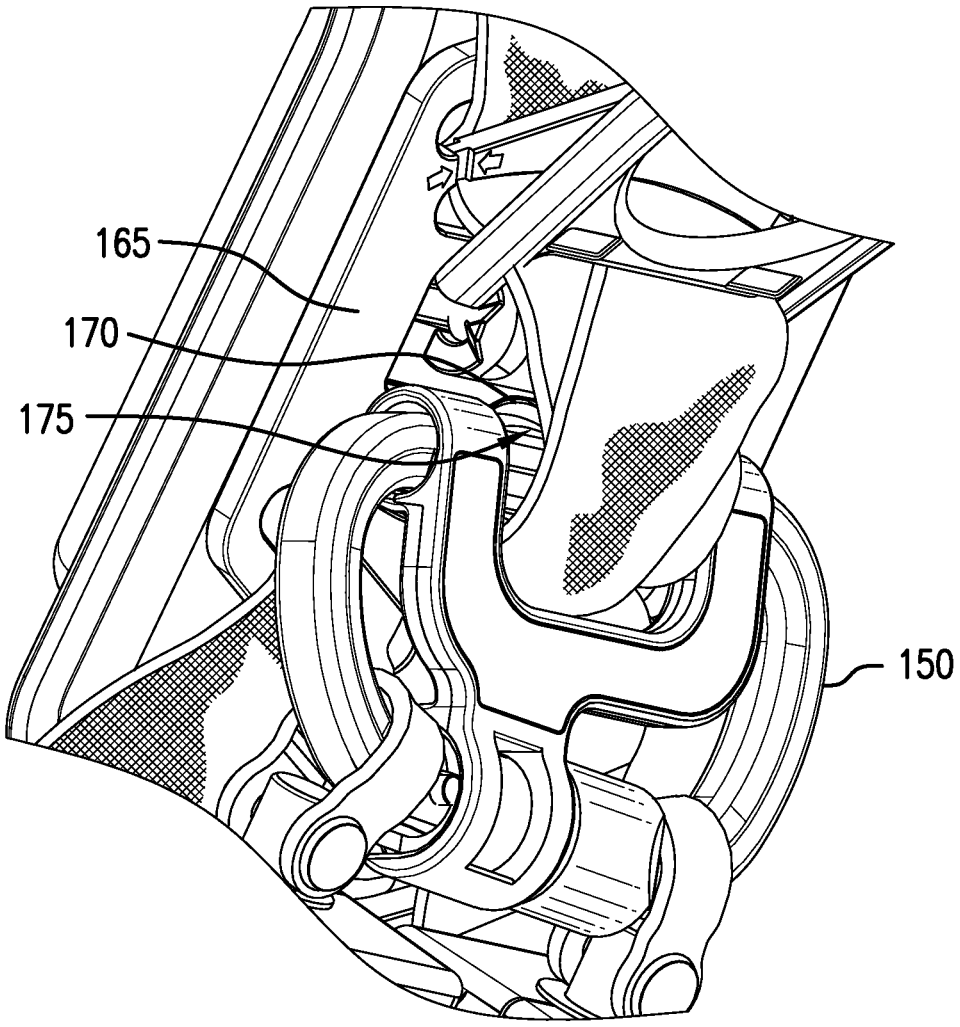

FIGS. 1*a*-1*c* depict a sketch of a field implementation of an exemplary Self-Retracting Lifeline Connecting System (SRLCS) used for fall protection. In these figures, a workman 100 is working high above a river 105. The workman is depicted wearing an exemplary SRLCS 110. The SRLCS has two exemplary Self-Retracting Lifelines (SRLs) 115, 120 attached to the SRLCS 110. Each SRL has a connection device 125, 130 which is attached to a girder 135 at two attachment locations 140, 145. The SRLs 115, 120 are attached to the SRLCS 110 via a carabiner 150. In this example, the carabiner 150 captures a webbing 155 of a harness 160. In various examples, the weight of the two SRLs 115, 120 may not cause the webbing 155 to sag because the carabiner 150 supporting the SRLs 115, 120 is attached to a D-pad 165 in the harness 160 via a D-pad clip 170. The D-pad clip 170 provides a tunnel 175, throughout which the carabiner 150 resides. The D-pad clip 170 is rigidly attached to the D-pad 165 which has webbing slots that guide the webbing 155 in a criss-cross fashion 180 over the D-pad clip. The tunnel 175 not only supports the weight of the carabiner 150 and the two SRLs 115, 120, but also provides a pathway to receive and guide the carabiner 150 behind the webbing 155, which ensures easy and proper installation. The carabiner's use of the tunnel pathway 175 provided by the D-pad clip 170 can be used in addition to a D-ring 185, which may then be available if a rescue hook is needed. The D-ring 185 can then be free of the heavy SRLs 115, 120 so that it doesn't cause the webbing 155 to sag, and its aperture is free for emergency use.

Figure 2A:
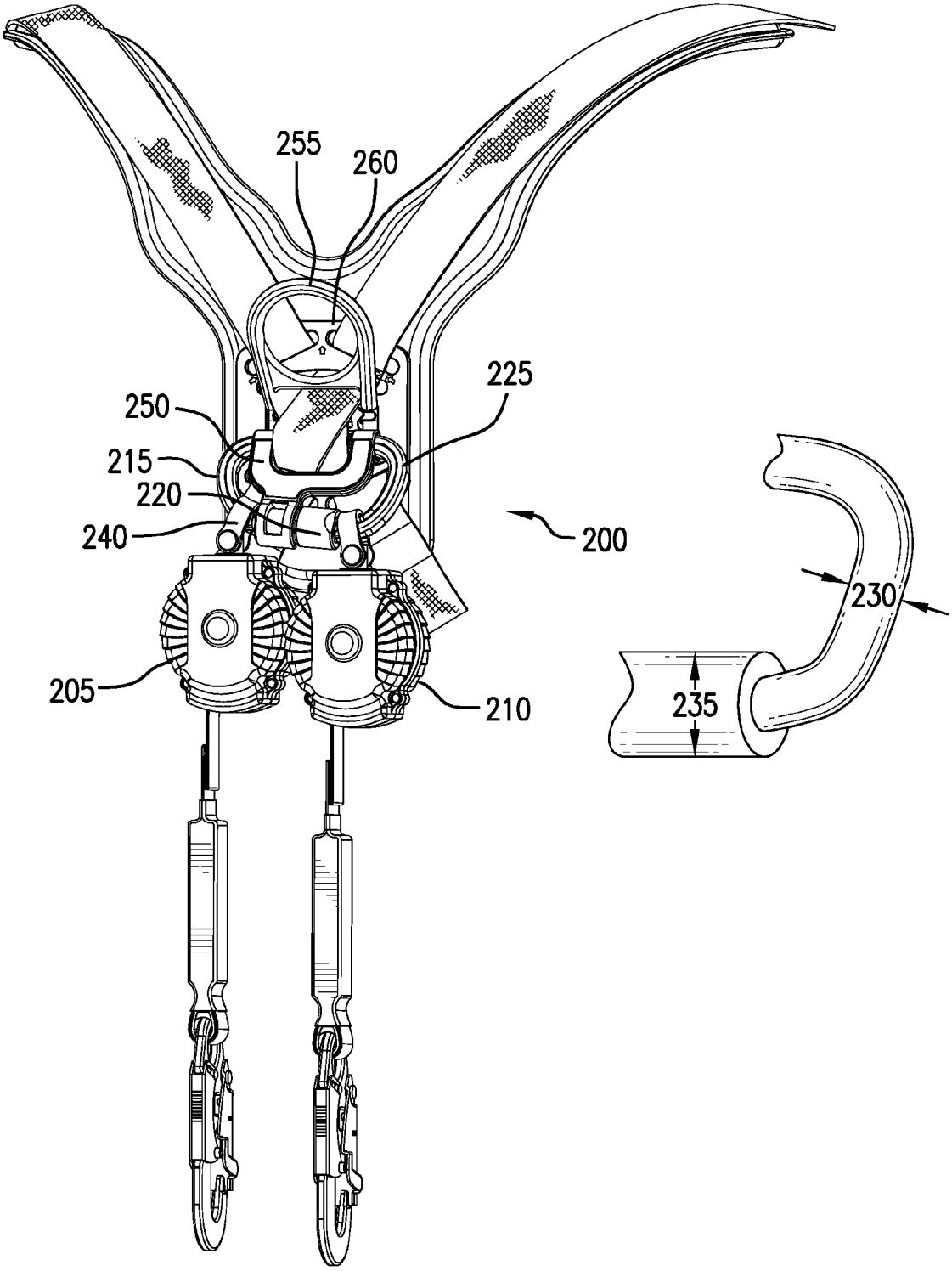
FIGS. 2*a*-2*b* depict two perspective views of a safety harness with an exemplary SRLCS with dual Self-Retracting Lifelines (SRLs) connected.
Figure 2B:
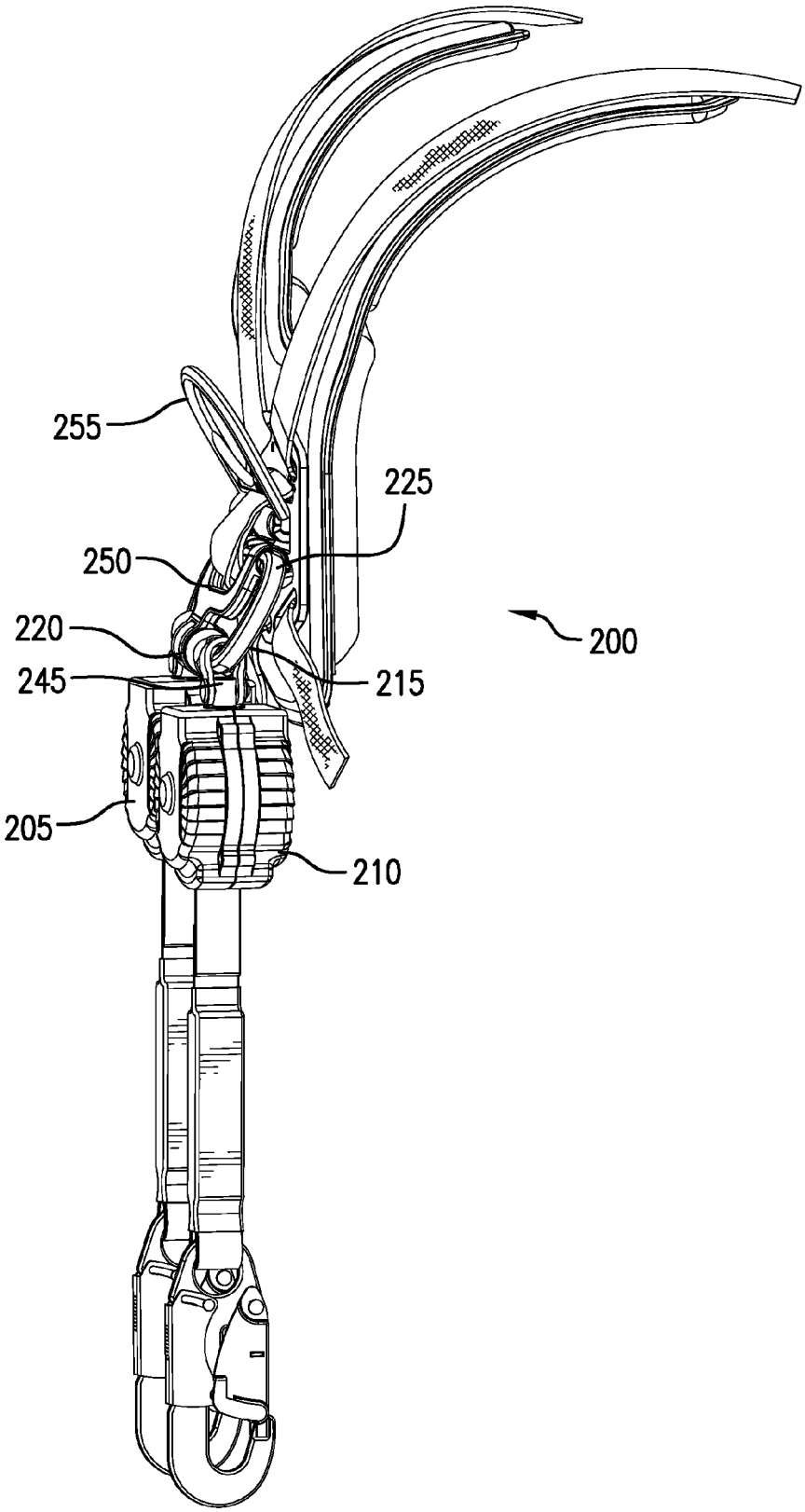

FIGS. 2*a*-2*b* depict two perspective views of a safety harness with an exemplary SRLCS with dual Self-Retracting Lifelines (SRL) connected. In FIGS. 2*a*-2*b*, an exemplary SRLCS 200 is depicted with two exemplary SRLs 205, 210 attached to a carabiner 215. The carabiner is shown with an exemplary gate 220. The non-gate portion 225 of the carabiner 215 has a small cross-sectional diameter 230. The gate 220 has a large cross-sectional diameter 235. The SRLs 205, 210 are attached on either side of the gate 220. Each SRL 205 210 is attached to the carabiner via a swivel connector 240, 245. The large cross-sectional diameter 235 of the gate provides separation of the two SRLs 205, 210. In this example, the gate requires at least two separate and distinct actions to open. One, the gate 220 must be twisted. Two, the gate must be opened. Only after the twist has been performed may the gate 220 be swung open. A webbing retainer clip 250 is connected to the carabiner 215. Also depicted in this exemplary figure is a D-ring 255. The D-ring 255 has a large device aperture 260, which may be used by a safety hook in an emergency situation or by other connecting devices.

Figure 3A:
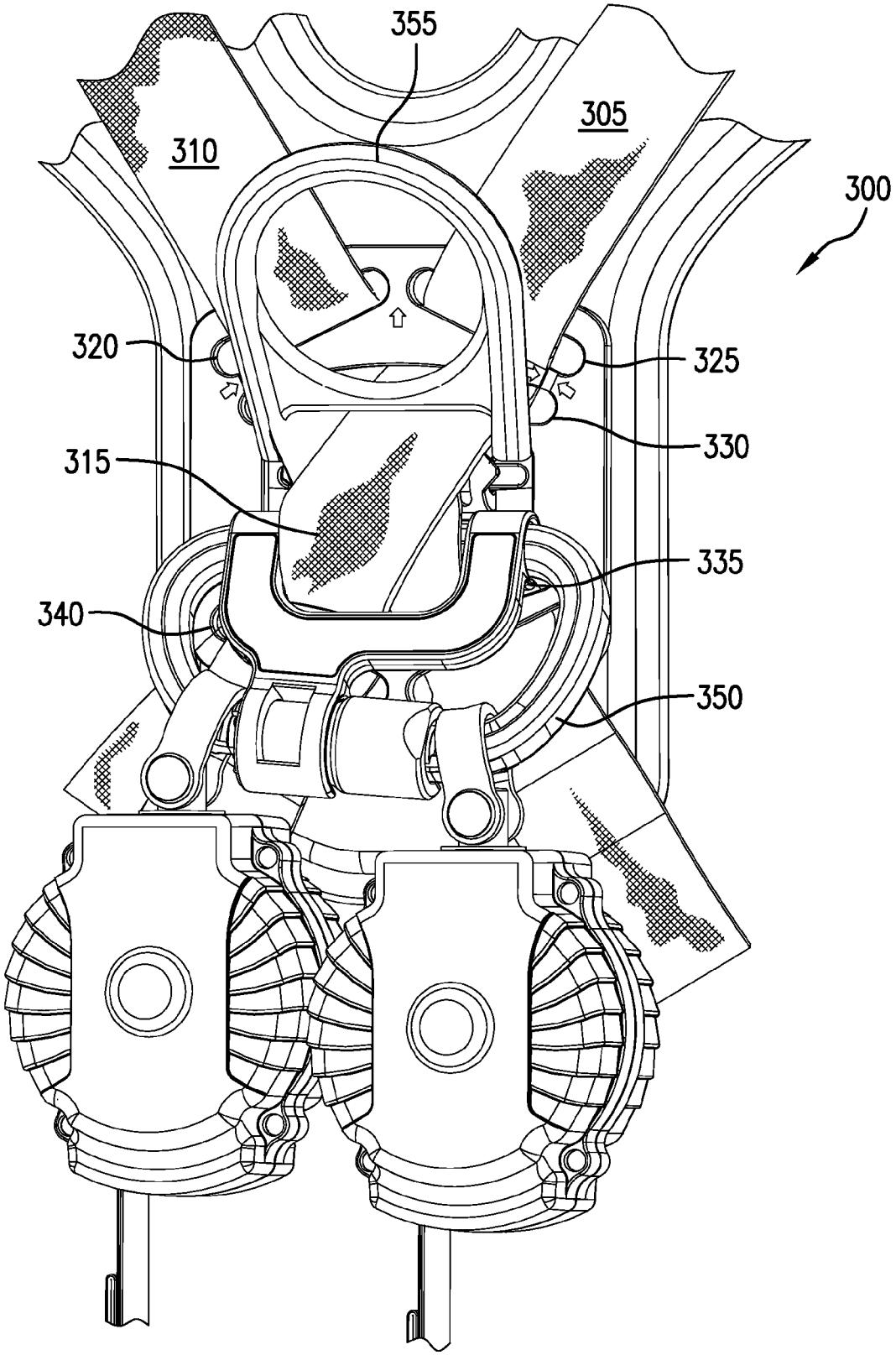
FIGS. 3*a*-3*b* depict two close-up perspective views of a safety harness with an exemplary SRLCS showing a webbing tunnel.
Figure 3B:
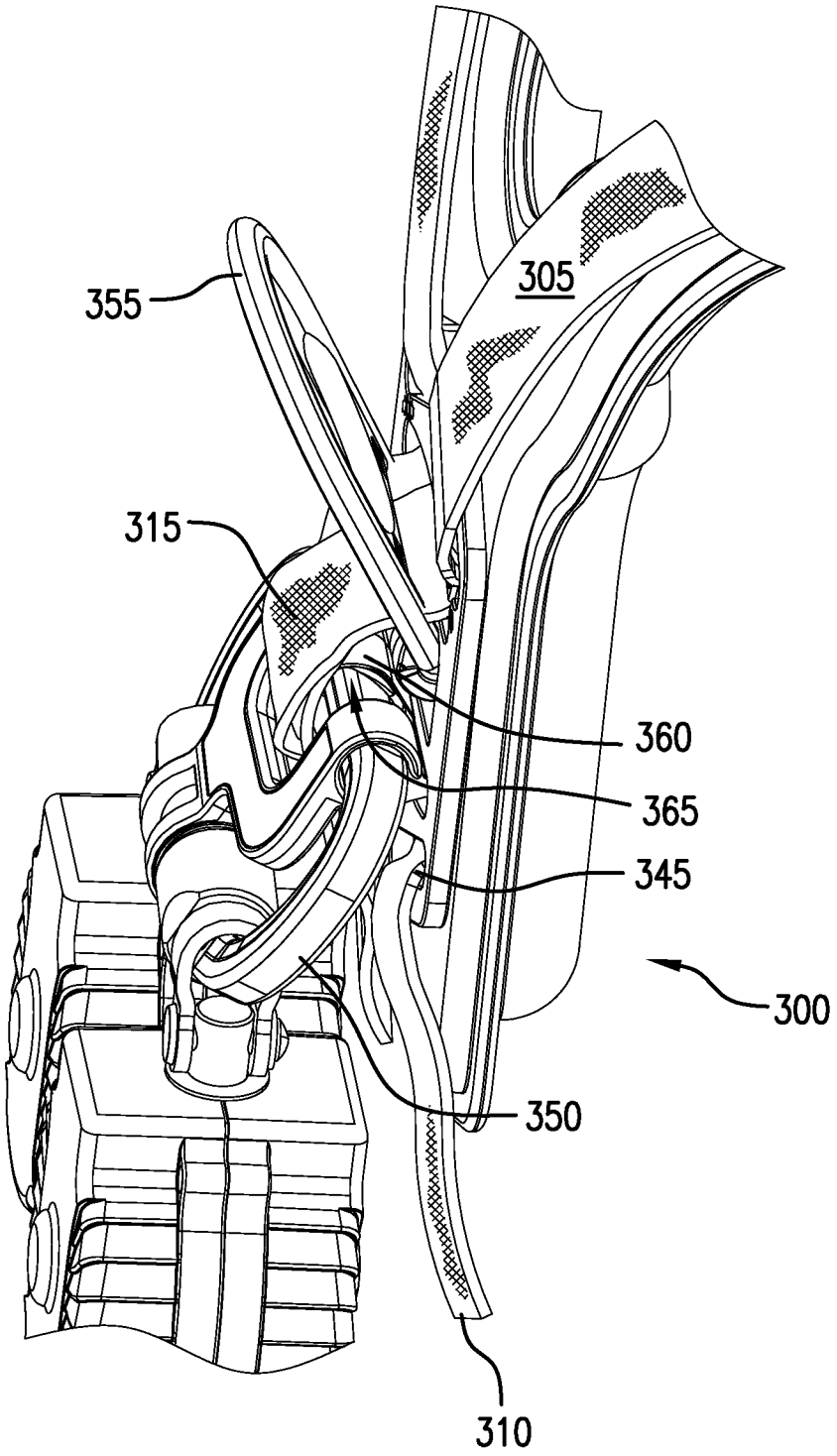

FIGS. 3*a*-3*b* depict two close-up perspective views of a safety harness with an exemplary SRLCS showing a webbing tunnel. In FIGS. 3*a*-3*b*, an exemplary D-pad 300 is depicted. Two sections of webbing 305 310 are also depicted. The webbing criss-crosses at a crossover point 315. This exemplary D-pad is depicted with six distinct webbing apertures 320, 325, 330, 335, 340, 345. In this exemplary figure, each piece of webbing 305, 310 is threaded through four of the six apertures 320-345. The first webbing section 305 is serially threaded through webbing apertures 320, 330, 335, 345. The second webbing aperture 310 is threaded through webbing apertures 325, 330, 335, 340. As depicted in this example, a carabiner 350 has captured both sections of the webbing 305, 310 at a location near the crossover point 315. In this illustrative embodiment, a D-ring 355 is depicted as having captured the two sections of webbing 305, 310 at a location near the crossover point 315 as well. In FIG. 3*b*, an exemplary D-pad clip 360 is depicted. The carabiner 350 is shown residing within a tunnel 365 formed in the D-pad clip 360.

Figure 4A:
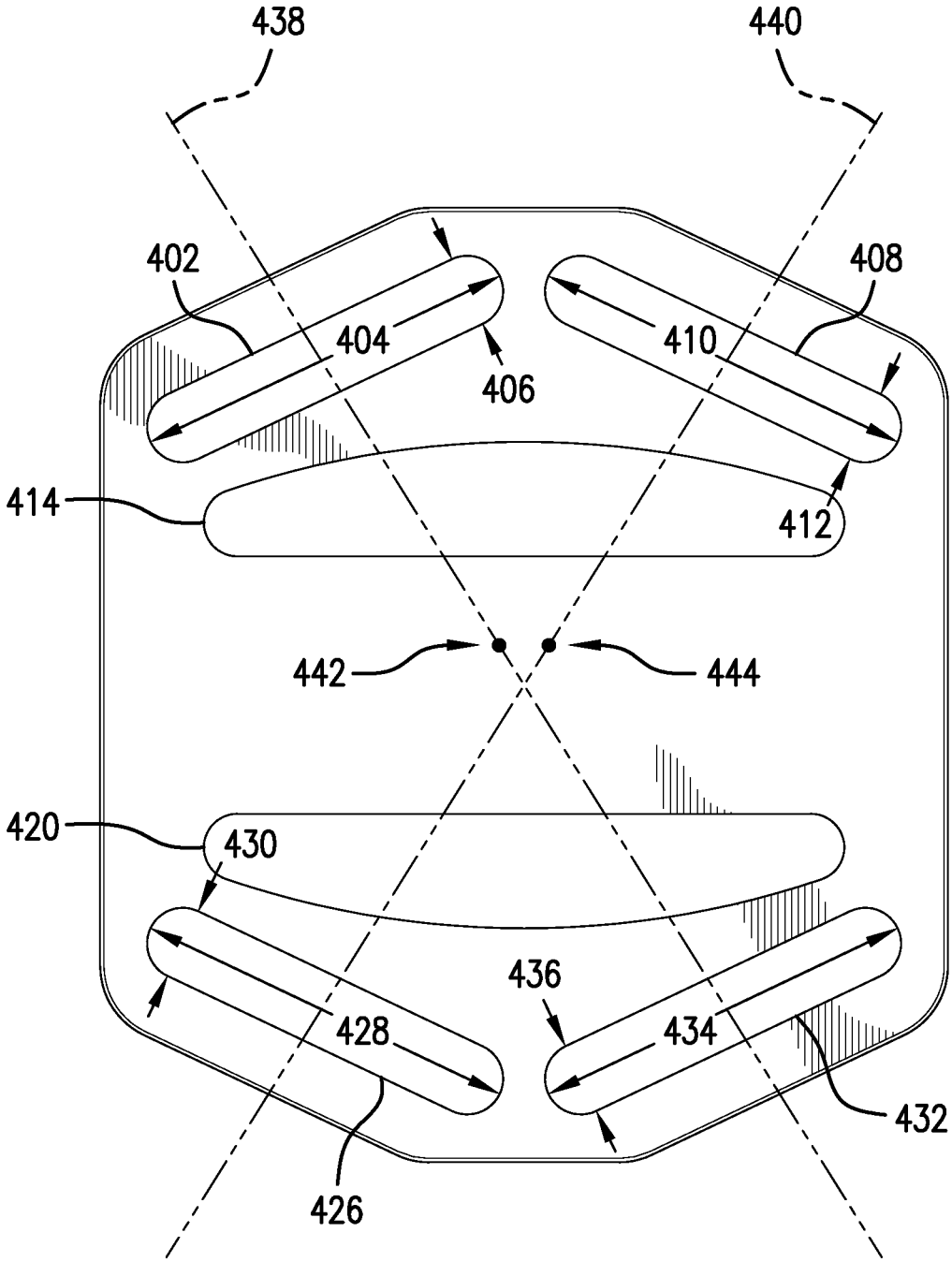
FIGS. 4*a*-4*b* depict two plan views of two exemplary D-pads.
Figure 4B:
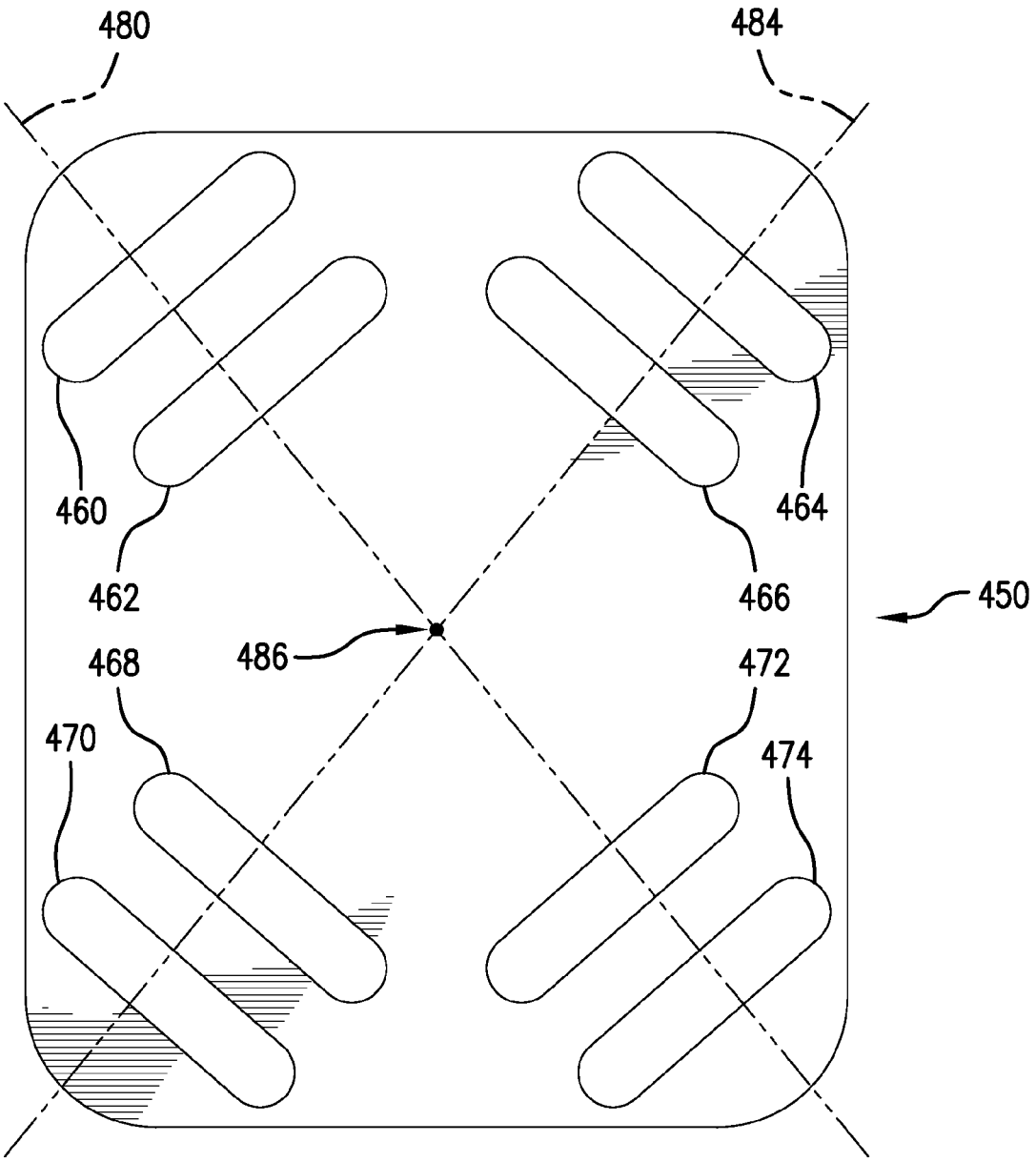

FIGS. 4*a*-4*b* depict two plan views of two exemplary D-pads. In FIG. 4*a*, an exemplary D-pad 400 is depicted. In this example, the exemplary D-pad 400 is depicted with six webbing apertures 402, 408, 414, 420, 426, 432. Aperture 402 has a major dimension 404 and a minor dimension 406. Aperture 408 has a major dimension 410 and a minor dimension 412. Aperture 426 has a major dimension 428 and a minor dimension 430. Aperture 432 has a major dimension 434 and a minor dimension 436. In this exemplary embodiment, major dimension 404 is approximately parallel to major dimension 434. Also approximately parallel in this example are major dimensions 410 and 428. A perpendicular bisector 438 of major dimension 404 also approximately bisects major dimension 434 in a nearly perpendicular fashion in this exemplary figure. A perpendicular bisector 440 of major dimension 410 also approximately bisects major dimension 428 in a nearly perpendicular fashion. The perpendicular bisector 438 has a midpoint 442 between the two major dimensions 404, 434 that it bisects. The perpendicular bisector 440 has a midpoint 444 between the two major dimensions 410, 428 that it bisects. The two midpoints 442, 444 are nearly coincident in this exemplary D-pad figure. A section of webbing can be threaded through apertures that share a perpendicular bisector, without requiring the webbing to twist or turn except in the direction of its thickness. If one were to thread a section of webbing through apertures 402 and 432, for example, no twisting of turning of the webbing may be required except in the direction of its thickness. Note that this section of webbing that goes through apertures 402 and 432 can also go through the larger webbing apertures 414 420, which both reside between apertures 402, 432. A section of webbing that may be threaded through apertures 408, 426 may also go through apertures 414, 420. In this manner, apertures 414, 420 are shared apertures.

In FIG. 4*b*, another exemplary D-pad 450 is depicted. In this example, the exemplary D-pad is depicted with eight webbing apertures 460, 462, 464 466, 468, 470, 472, 474. In this exemplary figure, apertures 460, 462, 472, 474 all have major dimensions parallel to each other and all approximately share a perpendicular bisector 480. Apertures 464, 466, 468, 470 all have major dimensions parallel to each other and all approximately share a perpendicular bisector 484. These two bisectors 480, 484 cross at an approximate midpoint 486 between the symmetric aperture pairs, (460 and 474 being symmetric, 462 and 472 being symmetric, 464 and 470 being symmetric, and 466 and 468 being symmetric). In this exemplary embodiment a section of webbing can be threaded through apertures 460, 462, 472, 474 without having to turn or twist except in the direction of its thickness. Another section of webbing can be threaded through apertures 464, 466, 468, 470 without having to turn or twist except in the direction of its thickness. The two sections of webbing may then criss-cross at or near the midpoint 486.

Figure 5C:
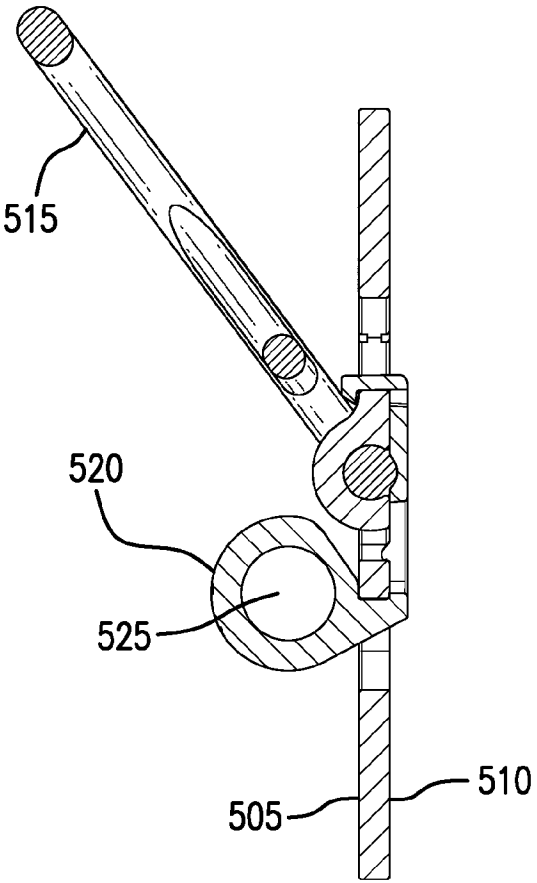
FIGS. 5*a*-5*c* depict a perspective and two side views of the installation of an exemplary D-pad clip used to create a webbing tunnel.
Figure 5B:
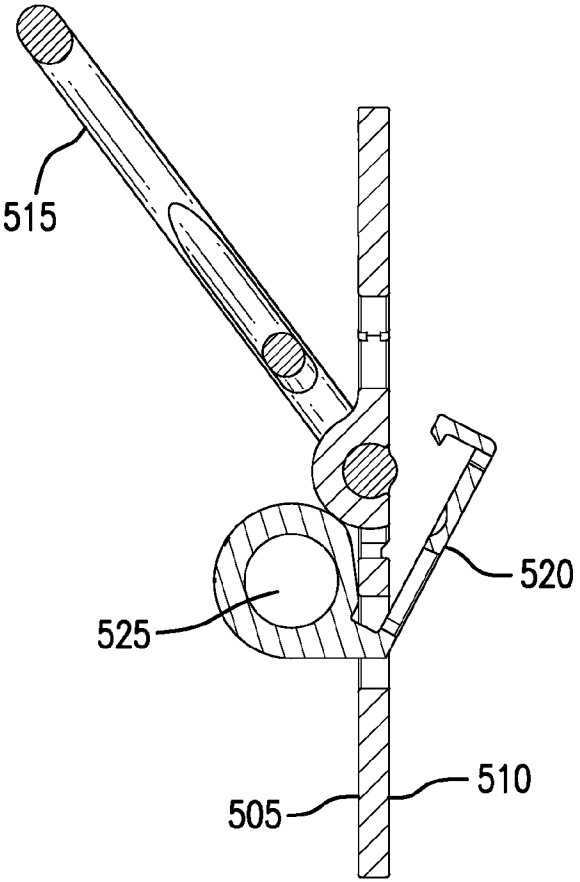
Figure 5A:
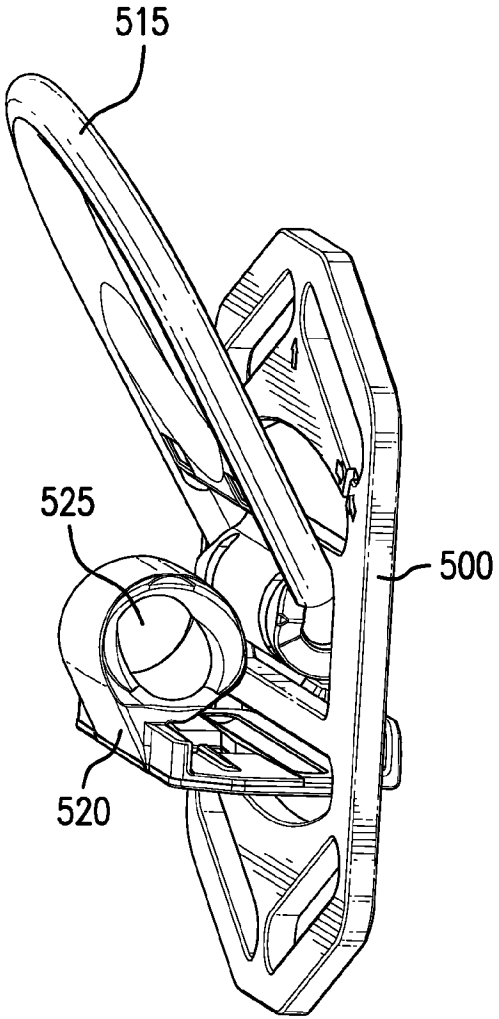

FIGS. 5*a*-5*c* depict a perspective view and two side views of the installation of an exemplary D-pad clip used to create a webbing tunnel. In FIGS. 5*a*-5*c*, an exemplary D-pad is depicted 500. The D-pad 500 has a top surface 505 and a bottom surface 510. The D-pad is shown attached to a D-ring 515. A D-pad clip 520 is shown being inserted into the D-pad 500 in FIG. 5*a*. FIG. 5*b* shows a side cross-sectional view of the D-pad clip 520 being inserted into the D-pad 500. FIG. 5*c* shows a side cross-sectional view of the D-pad clip when it is attached to the D-pad 500. In this exemplary embodiment, the D-pad clip has a tunnel 525 that is parallel to the top surface 505 of the D-pad 500. This example depicts the tunnel at a location where the crossover point of two sections of threaded webbing may be in close proximity to the tunnel. In this exemplary embodiment the D-pad clip 520 clips onto the D-pad 500. In some embodiments, a D-pad clip may be created as part of a unitary D-pad. In other exemplary embodiments, a D-pad clip may be attached to a D-pad using a screw or screws. Some embodiments may affix a D-pad clip to a D-pad with one or more rivets. Some exemplary embodiments may affix a D-pad clip to a D-pad using adhesives.

Figure 6A:
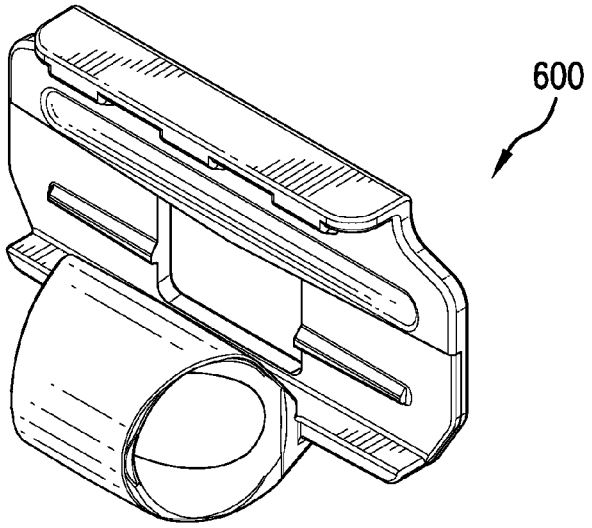
FIGS. 6*a*-6*d* depict perspective, plan, top, and side views of an exemplary D-pad clip used to create a webbing tunnel.
Figure 6B:
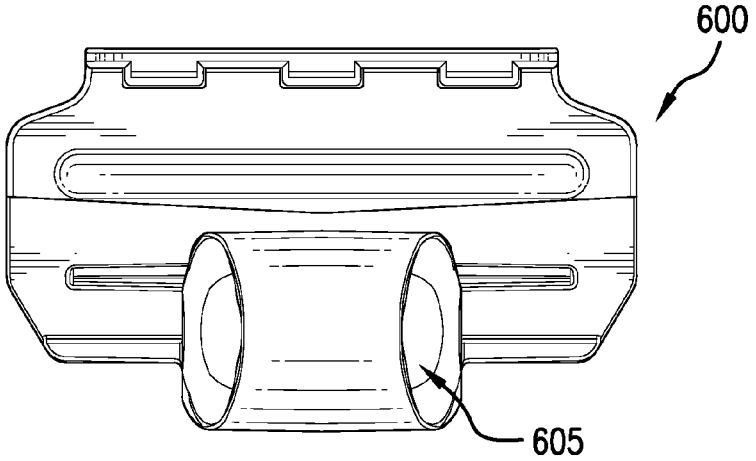
Figure 6C:
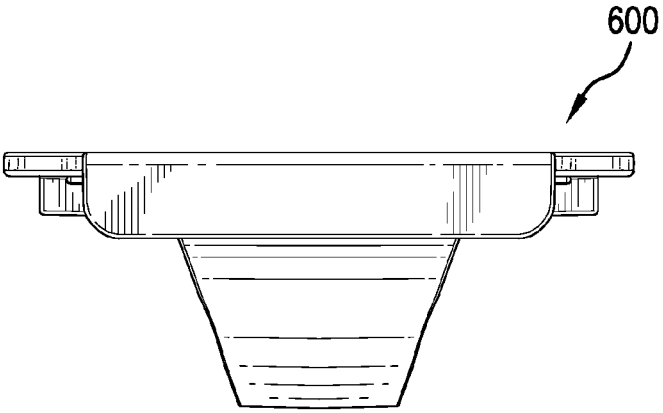
Figure 6D:
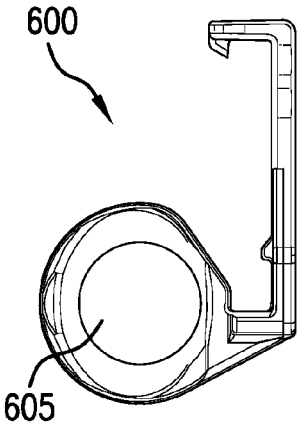

FIGS. 6*a*-6*d* depict perspective, plan, top, and side views an exemplary D-pad clip used to create a webbing tunnel. In FIG. 6*a*, a perspective view of an exemplary D-pad clip 600 is shown in isolation. FIG. 6*b* depicts a plan view perspective of the same exemplary D-pad clip 600. In FIG. 6*c*, a top perspective view of the same exemplary D-pad clip 600 is shown. And in FIG. 6*d*, a side perspective view of the same exemplary D-pad clip 600 is shown. A tunnel 605, through which a carabiner may be inserted is depicted in FIG. 6*d*.

Figure 7A:
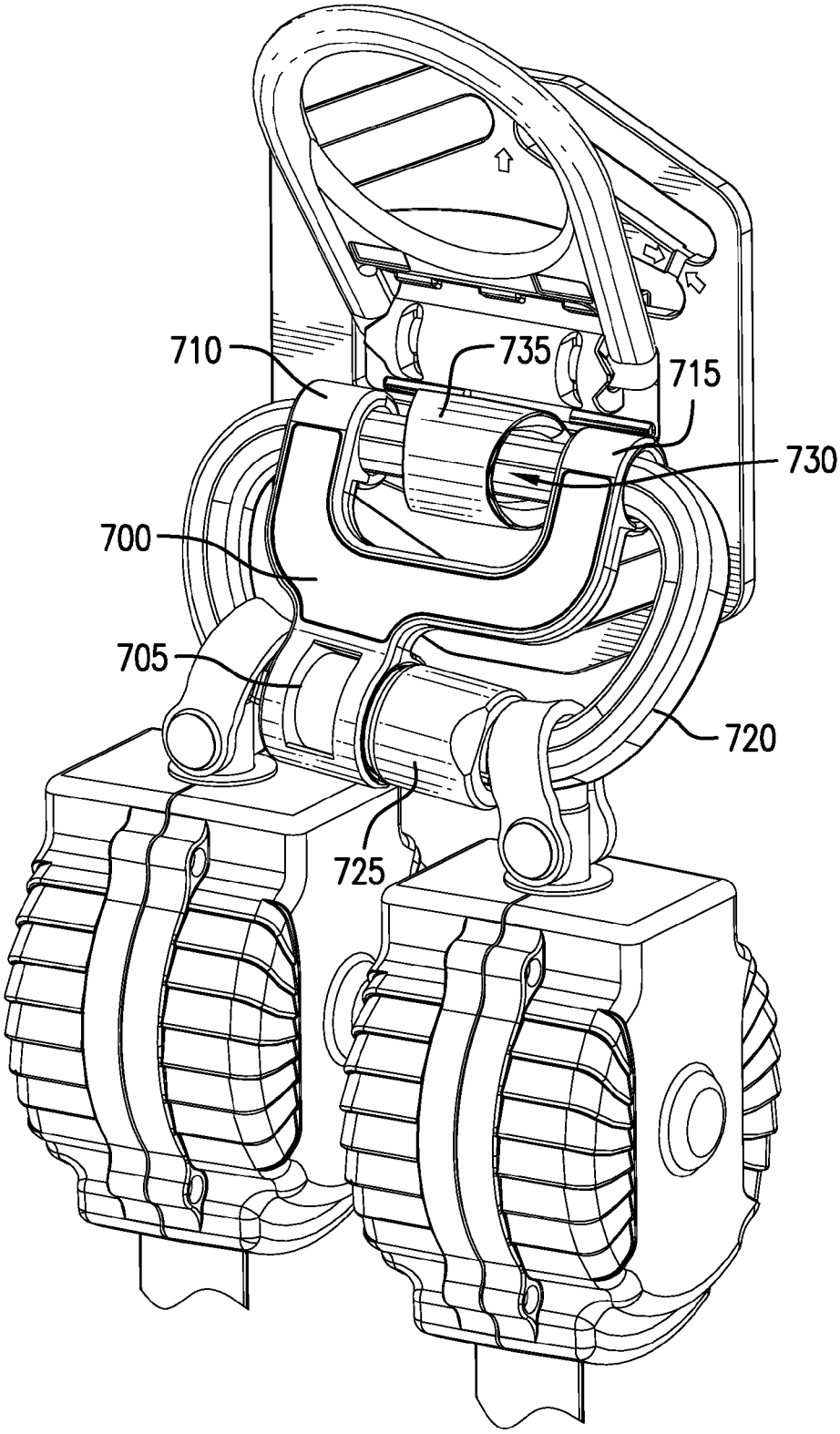
FIGS. 7*a*-7*b* depict two close-up perspective views of an exemplary SRLCS showing an exemplary webbing retainer clip.
Figure 7B:
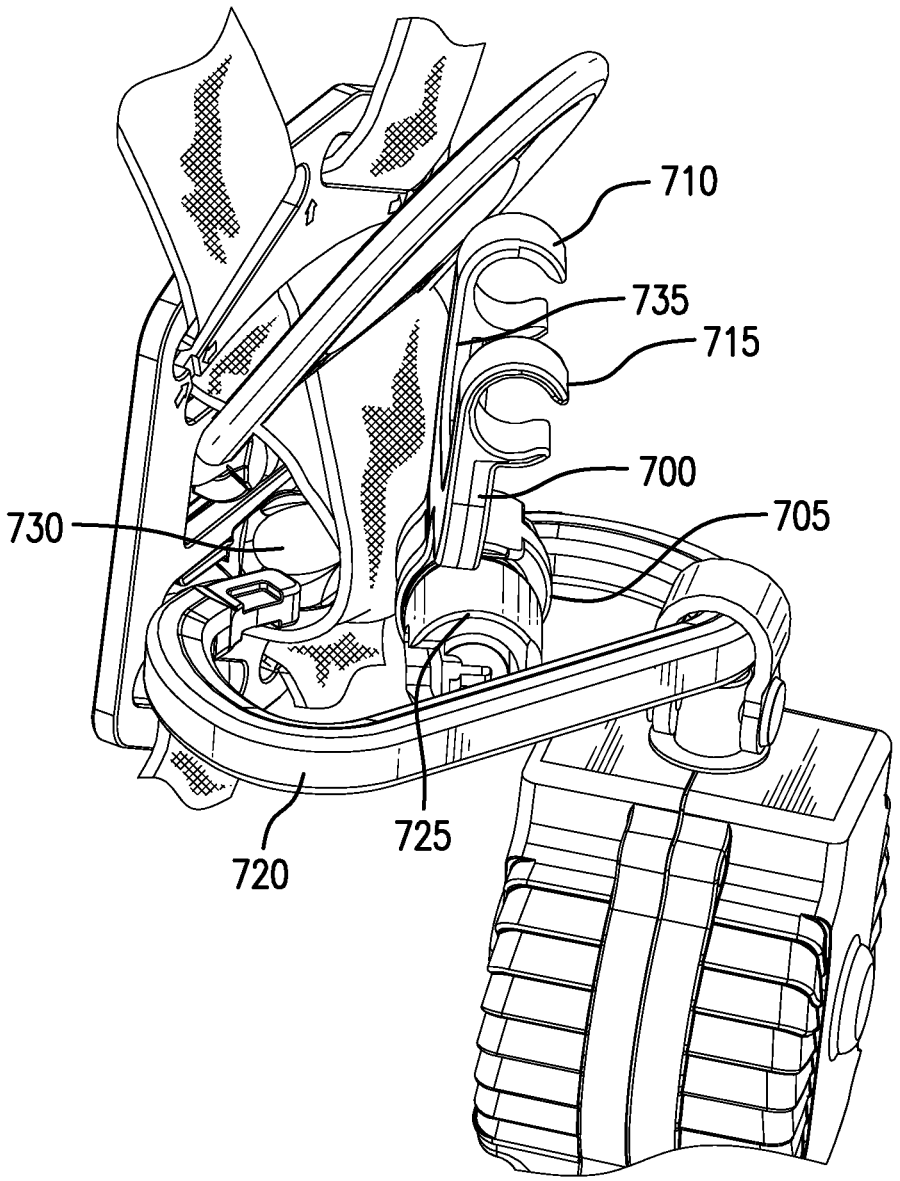

FIGS. 7*a*-7*b* depict two close-up perspective views of an exemplary SRLCS showing an exemplary webbing retainer clip. In FIGS. 7*a*-7*b*, an exemplary webbing retainer clip 700 is depicted. In FIG. 7*a*, the webbing retainer clip 700 is shown attached at three points 705, 710, 715 to a carabiner 720. The first attachment point 705 is located at a gate 725 of the carabiner 720. The second and third attachment points 710, 715 are located near a tunnel 730 of a D-pad clip 735. The first attachment point 705 completely circumscribes the gate 725, and thus must be attached when the gate 725 is open. The first attachment point 705 is loosely coupled to the gate 725 and can freely rotate about the gate 725. This loose coupling may permit the webbing retainer clip 700 to rotate freely about the gate 725 in the event of a fall or other such shock event. Because the webbing retainer clip 700 can freely rotate about the gate 725, it will not rotate the gate 725 in such an event, which might otherwise serve to perform the first action needed to open the gate 725. The second and third attachment points 710, 715 snap onto the carabiner. The second and third attachment points 710, 715, together with a section of the carabiner 730 define a webbing aperture 735. The two sections of webbing that may be inserted into the D-pad may be inserted through this defined webbing aperture 735 near the criss-cross point of the two sections of webbing. The webbing retainer clip may help to keep the carabiner centered upon the webbing. Its large defined webbing aperture 735 may permit ease of installation. This large defined webbing aperture 735 also may permit the sections of webbing which thread therethrough to slide freely without binding.

Figure 8:
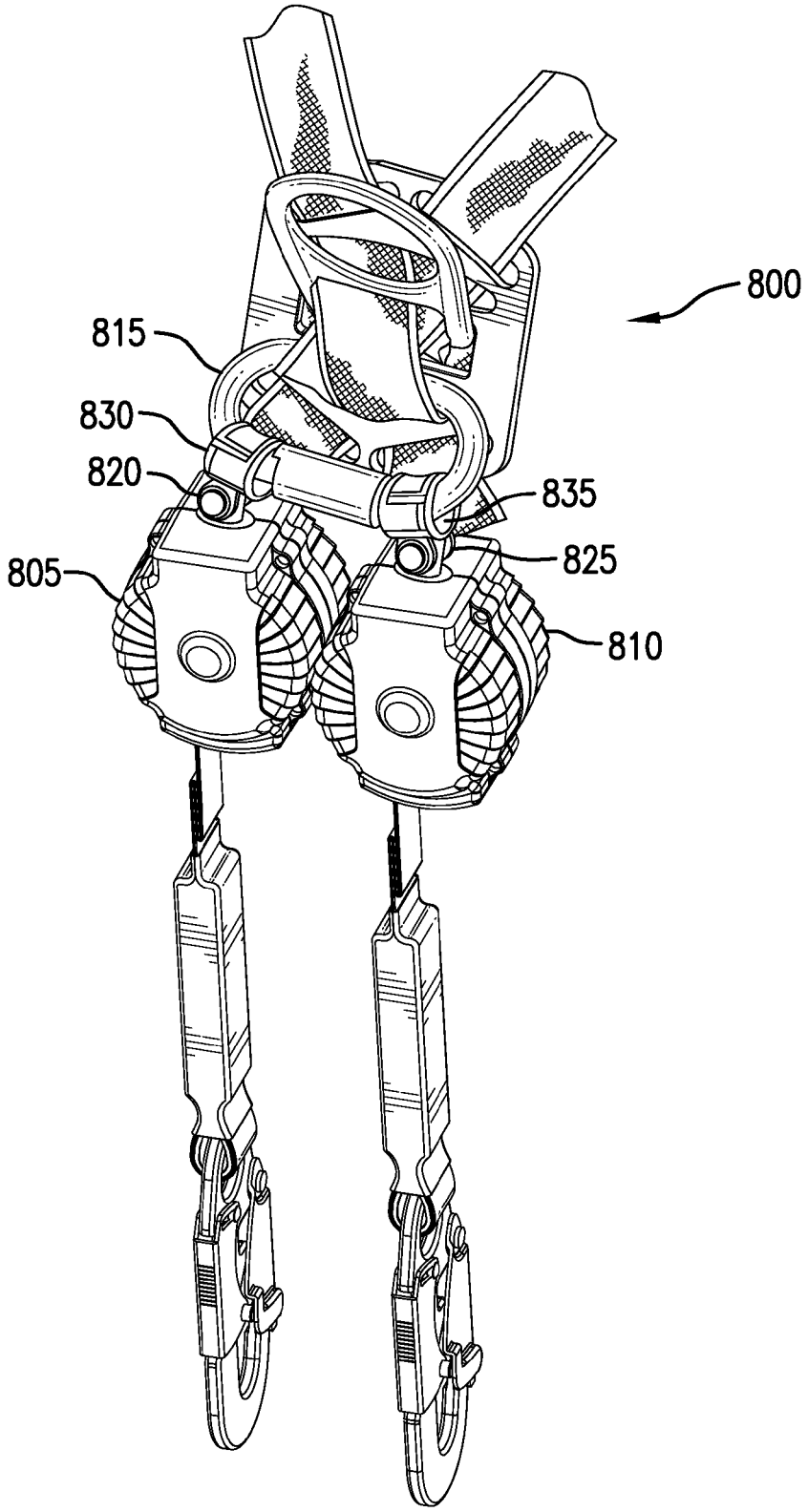
FIG. 8 depicts a perspective view of a safety harness with an exemplary SRLCS showing exemplary SRL two-piece bushings.

FIG. 8 depicts a perspective view of a safety harness with an exemplary SRLCS showing exemplary SRL two-piece bushings. In FIG. 8, an exemplary SRLCS 800 is depicted. In this exemplary embodiment, two SRLs 805, 810 are connected to a carabiner 815. Each SRL 805, 810 is connected to the carabiner 815 via a swivel connector 820 825. Each swivel connector 820, 825 in this example has a bushing 830, 835. The bushing may be made of a synthetic material to help prevent abrasion of the carabiner 815 as the swivel connectors 820, 825 move during use.

Figure 9A:
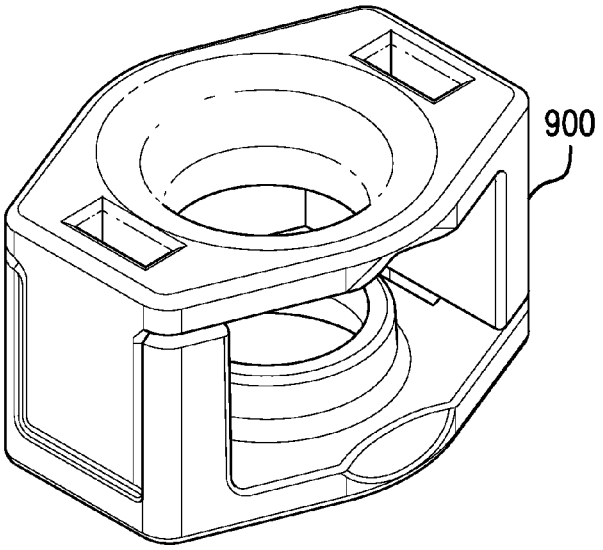
FIGS. 9*a*-9*d* depict a perspective view and plan views of an exemplary two-piece SRL bushing and side cross-sectional views of each bushing piece.
Figure 9B:
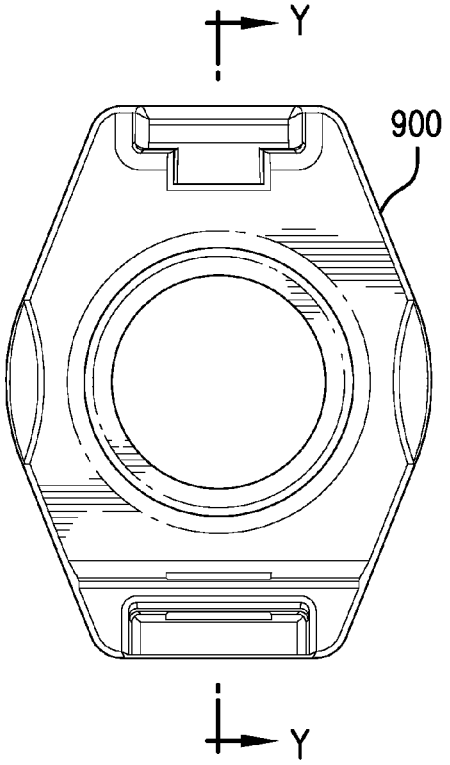
Figure 9C:
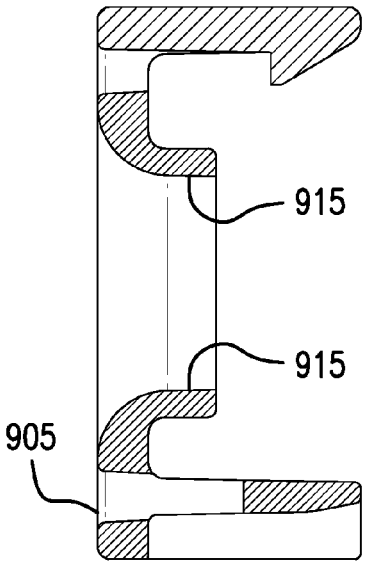
Figure 9D:
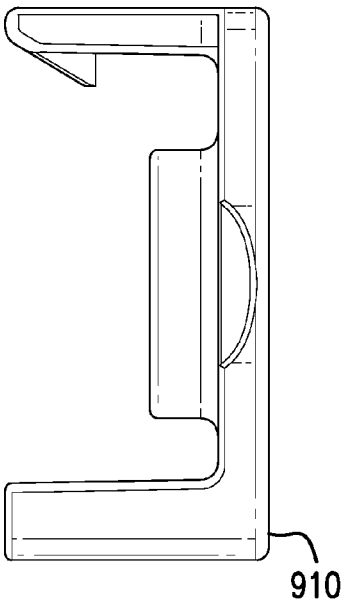

FIGS. 9*a*-9*d* depict a perspective view and plan views of an exemplary two-piece SRL bushing and side cross-sectional views of each bushing piece. In FIG. 9*a*, an exemplary two-piece bushing is depicted in an assembled state 900. FIG. 9*b* shows the same exemplary two-piece bushing 900 in a plan view. FIGS. 9*c*-9*d* show each individual piece 905 910 of this exemplary two-piece assembly. A bushing surface 915 is depicted in FIGS. 9*a*-9*d*. This bushing surface 915 is the surface that will contact the outer surface of a carabiner when SRLs are attached to it.

Although various embodiments have been described with reference to the figures, other embodiments are possible. For example, a flexible D-pad may be used along with a semi-rigid D-pad clip. In some embodiments, a D-pad may be semi-rigid and a rigid or semi-rigid D-pad clip may be affixed to it. In various embodiments, a tunnel created by a D-pad clip may be made longer or shorter. Some exemplary embodiments may integrate the D-pad clip into the D-pad itself. In accordance with another embodiment, a D-pad clip may have two parallel tunnels presenting the user with a choice of tunnels to use. In another embodiment, a D-pad clip may provide for connection of a D-ring in addition to providing a tunnel.

In various embodiments, apparatus and methods may involve webbing retainer clips made of plastic. In another exemplary embodiment the webbing retainer clip may be secured to the carabiner with one or more screws or bolts. In accordance with another embodiment, the webbing retainer clip may be made with second and third attachment points that connect to a D-pad clip instead of or in addition to connecting to a carabiner. In an exemplary embodiment, single piece SRL bushings may be used. These bushings may snap into the swivel connection from one side of the swivel connection aperture. In accordance with another embodiment, the bushings may be made of a material with an embedded lubricant, such as graphite.

In one exemplary aspect, a method of constructing a fall-protection safety harness includes providing a wearable safety harness including a length of webbing, providing a D-pad having a top and a bottom surface, the D-pad including webbing apertures for attachment to a webbing, providing a D-pad clip attachable to the D-pad, the D-pad clip providing a lumen located adjacent to the top side of the D-pad at or near the location of the location of the webbing criss-cross and oriented about approximately parallel to the top surface of the D-pad, and inserting at least a portion of the length of the webbing through the webbing aperture to securely couple the unitary solid body to the safety harness.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A fall-protection safety apparatus for connecting a webbed safety harness to Self-Retracting Lifelines (SRLs), the apparatus comprising:

a first unitary body with a top surface and a bottom surface, the body comprising:

a first pair of webbing apertures, each aperture of the first pair extending through the body between the top surface and the bottom surface, and each aperture of the first pair having a first major dimension sized to receive a webbing having up to a predetermined width and having a first minor dimension sized to receive a thickness of the webbing, and the two apertures of the first pair aligned to each other such that the first major dimensions of both apertures of the first pair are substantially parallel to each other, the apertures of the first pair arranged such that a first intersecting line intersects both apertures of the first pair permitting a first linear portion of the webbing to be threaded sequentially through both apertures of the first pair; and a second pair of webbing apertures, each aperture of the second pair extending through the body between the top surface and the bottom surface, and each aperture of the second pair having a second major dimension sized to receive the predetermined width of the webbing and having a second minor dimension sized to receive the webbing's thickness, and the two apertures of the second pair aligned to each other such that the second major dimensions of both apertures of the second pair are substantially parallel to each other and such that a second intersecting line intersects both apertures of the second pair permitting a second linear portion of the webbing to be threaded sequentially through both apertures of the second pair, and the second pair of apertures further aligned such that the first linear portion of webbing and the second linear portion of webbing form a criss-crossing pattern at or near a point of coincidence that corresponds to a point at which the first intersecting line crosses the second intersecting line;

a second unitary body connecting to the first unitary body, the second unitary body providing a tunnel sized to accommodate a carabiner, the tunnel oriented approximately parallel to the top surface of the first unitary body, and the tunnel located at or near the point of coincidence permitting the carabiner to capture both of said portions of webbing simultaneously at or near a location of the criss-crossing pattern;

the apparatus further comprising said webbing connected to the first unitary body by passing through the webbing apertures such that the two portions of webbing provide the criss-crossing pattern at or near the point of coincidence, the webbing capable of being secured to another object;

the apparatus further comprising the carabiner inserted through the tunnel of the second unitary body and capturing the criss-crossing pattern;

the apparatus further comprising two SRLs attached to the carabiner; and, the apparatus further comprising a pivotable webbing retainer clip having an opening through which the criss-crossing pattern of webbing portions is threaded to retain the criss-crossing pattern between the webbing retainer clip and a first portion of the carabiner, the retainer clip configured to snap onto the carabiner.

2. The fall-protection safety apparatus of claim 1, wherein the first unitary body is curved to form to a portion of a human body.

3. The fall-protection safety apparatus of claim 1, wherein the webbing retainer is configured to snap onto a second portion of the carabiner opposite the first portion of the carabiner, thereby dividing the carabiner laterally into a first section and a second section wherein a first of the two SRLs is attached to the carabiner within the first section and a second of the two SRLs is attached to the carabiner within the second section.

4. A fall-protection safety apparatus for connecting a webbed safety harness to Self-retracting Lifelines (SRLs), the apparatus comprising:

a D-pad having a top surface and a bottom surface, the D-pad comprising:

a first slotted aperture extending through the D-pad between the top surface and the bottom surface, the first slotted aperture having a first long dimension and a first short dimension;

a second slotted aperture extending through the D-pad between the top surface and the bottom surface, the second slotted aperture having a second long dimension and a second short dimension, the second slotted aperture located such that the second long dimension is substantially parallel to the first long dimension and a first perpendicular bisector of the first long dimension is approximately collinear with a second perpendicular bisector of the second long dimension;

a third slotted aperture extending through the D-pad between the top surface and the bottom surface, the third slotted aperture having a third long dimension and a third short dimension; and a fourth slotted aperture extending through the D-pad between the top surface and the bottom surface, the fourth slotted aperture having a fourth long dimension and a fourth short dimension, the fourth slotted aperture located such that the fourth long dimension is substantially parallel to the third long dimension and a third perpendicular bisector of the third long dimension is approximately collinear with a fourth perpendicular bisector of the fourth long dimension, the third and fourth apertures further oriented such that a segment of the collinear perpendicular bisectors of the first and second long dimensions that lies between the first and second apertures has a first midpoint which is located at a point of coincidence approximately equal to a second midpoint of a segment of the collinear perpendicular bisectors of the third and fourth long dimensions that lies between the third and fourth apertures; and, a D-pad clip attachable to the D-pad, the D-pad clip providing a lumen located adjacent to the top side of the D-pad at or near a location of the point of coincidence of the first and second midpoints and oriented approximately parallel to the top surface of the D-pad, the lumen configured to receive a carabiner therethrough;

a webbing connected to the D-pad by passing through the slotted apertures such that two separate sections of said webbing form a criss-crossing pattern near the point of coincidence and above the lumen; and, a pivotable webbing retainer clip having an opening through which the criss-crossing pattern is threaded to retain the criss-crossing pattern between the webbing retainer clip and a first portion of the carabiner when the carabiner is inserted through the lumen of the D-pad clip, attachment clips of the webbing retainer clip, and is capturing the criss-crossing pattern of the two sections of webbing, the webbing retainer clip further configured to snap onto the carabiner.

5. The fall-protection safety apparatus of claim 4, further comprising one or more additional webbing apertures.

6. The fall-protection safety apparatus of claim 4, wherein the webbing is capable of being secured to another object.

7. The fall-protection safety apparatus of claim 4, wherein the D-pad is curved to substantially conform to a corresponding portion of a human body.

8. The fall-protection safety apparatus of claim 7, further comprising the carabiner inserted through the lumen and capturing the two sections of webbing at approximately the criss-crossing pattern of the webbing.

9. The fall-protection safety apparatus of claim 8, further comprising an SRL attached to the carabiner.

10. The fall-protection safety apparatus of claim 4, further comprising a D-ring attached to the D-pad.

11. A fall-protection safety apparatus for connecting a webbed safety harness to Self-retracting Lifelines (SRLs), the apparatus comprising:

a D-pad having a top surface and a bottom surface, the D-pad comprising:

a first pair of webbing apertures, each aperture of the first pair extending through the D-pad between the top surface and the bottom surface, and each aperture of the first pair having a major dimension sized to receive a webbing having up to a predetermined width, each aperture of the first pair having a first minor dimension sized to receive a thickness of the webbing and the two apertures of the first pair located such that a first linear segment of webbing can be routed sequentially through both apertures of the first pair without having to twist; and a second pair of webbing apertures, each aperture of the second pair extending through the D-pad between the top surface and the bottom surface, and each aperture of the second pair having a second major dimension sized to receive the predetermined width of the webbing, each aperture of the second pair having a second minor dimension sized to receive the thickness of the webbing and the two apertures of the second pair located such that a second linear segment of the webbing can be routed sequentially through both apertures of the second pair without having to twist, and the second pair of webbing apertures located such that the first linear segment and the second linear segment criss-cross forming a criss-crossing pattern;

a D-pad clip attachable to the D-pad, the D-pad clip providing a lumen located adjacent to the top side of the D-pad at or near a location of the criss-crossing pattern of the webbing and oriented approximately parallel to the top surface of the D-pad;

the apparatus further comprising the webbing connected to the D-pad by passing through the webbing apertures such that the two segments of the webbing form the criss-crossing pattern near a point of coincidence between said webbing apertures and above the lumen; and, a pivotable webbing retainer clip having an opening through which the criss-crossing pattern is threaded to retain the criss-crossing pattern between the webbing retainer clip and a first portion of a carabiner when the carabiner is inserted through the lumen of the D-pad clip, attachment clips of the webbing retainer clip, and is capturing the criss-crossing pattern of the two segments of the webbing, the webbing retainer clip further configured to snap onto the carabiner.

12. The fall-protection safety apparatus of claim 11, further comprising one or more additional webbing apertures.

13. The fall-protection safety apparatus of claim 11, wherein the webbing is capable of being secured to another object.

14. The fall-protection safety apparatus of claim 11, wherein the D-pad is curved to form to a portion of a human body.

15. The fall-protection safety apparatus of claim 13, further comprising the carabiner inserted through the lumen and capturing the two segments of webbing at approximately the criss-crossing pattern of the webbing.

16. The fall-protection safety apparatus of claim 15, further comprising an SRL attached to the carabiner.

* * * * *